US008739649B2

(12) United States Patent
Hisada et al.

(10) Patent No.: US 8,739,649 B2
(45) Date of Patent: Jun. 3, 2014

(54) OPERATION UNIT

(75) Inventors: Masahito Hisada, Aichi (JP); Yoshinori Takano, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 13/565,066

(22) Filed: Aug. 2, 2012

(65) Prior Publication Data

US 2013/0036852 A1 Feb. 14, 2013

(30) Foreign Application Priority Data

Aug. 8, 2011 (JP) ..... 2011-173237

(51) Int. Cl.
*G05G 1/08* (2006.01)

(52) U.S. Cl.
USPC ..... 74/504

(58) Field of Classification Search
USPC ..... 74/503, 504, 553, 554
See application file for complete search history.

(56) References Cited

U.S. PATENT DOCUMENTS

| | | | | |
|---|---|---|---|---|
| 3,385,116 | A * | 5/1968 | Carlson et al. | 74/10.54 |
| 5,083,477 | A * | 1/1992 | Geil | 74/553 |
| 2006/0012584 | A1* | 1/2006 | Vassallo et al. | 345/184 |
| 2011/0061489 | A1* | 3/2011 | Bulin et al. | 74/553 |

FOREIGN PATENT DOCUMENTS

| | | |
|---|---|---|
| DE | 8906891 | 7/1990 |
| GB | 2341224 | 3/2000 |
| JP | 3-76126 | 12/1991 |
| JP | 2010-122992 | 6/2010 |

* cited by examiner

*Primary Examiner* — Vicky Johnson
(74) *Attorney, Agent, or Firm* — Greenblum & Bernstein, P.L.C.

(57) ABSTRACT

An operation unit includes a case and an operation member molded integrally through injection molding. The operation member includes an outer surface and a slide portion supported by the case. The slide portion is slidable and movable relative to the case. The operation member further includes a knob operated by an operator, a parting line formed continuously from the slide portion to the knob along the outer surface, and a ridge line formed on the outer surface. At least part of the parting line is formed along the ridge line.

16 Claims, 5 Drawing Sheets

Fig.1
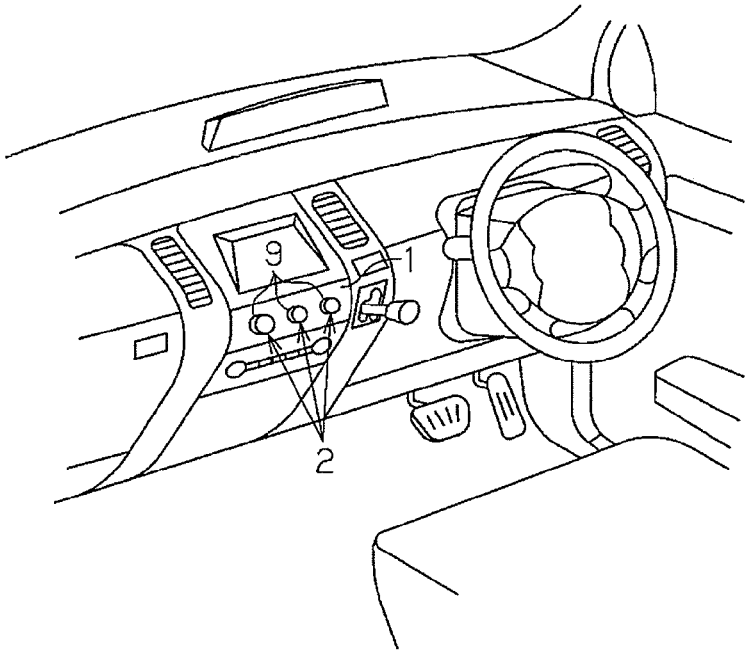
Fig.2(a)
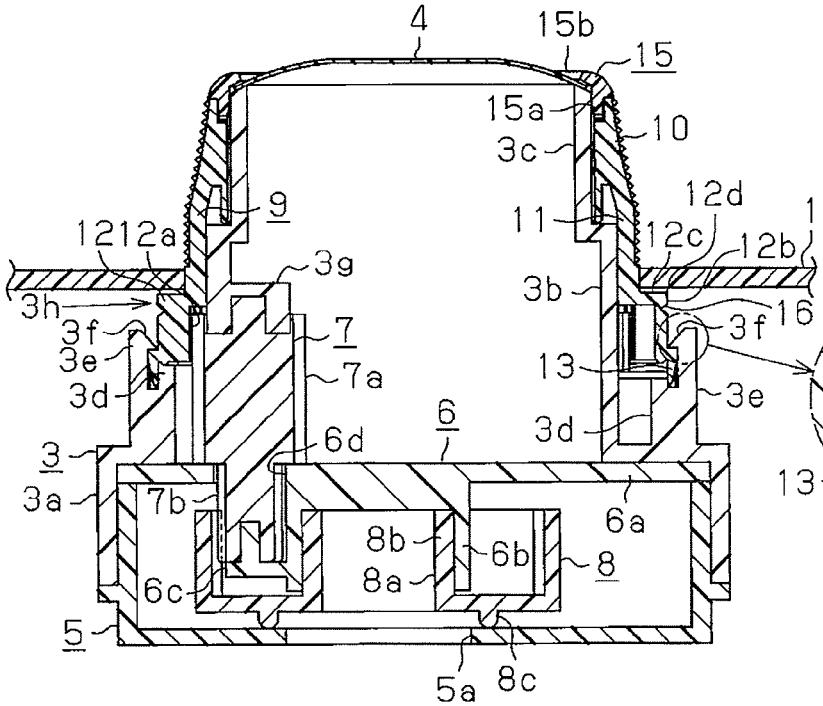
Fig.2(b)

OPERATION UNIT

CROSS-REFERENCE TO RELATED APPLICATIONS

This application is based upon and claims the benefit of priority from prior Japanese Patent Application No. 2011-173237, filed on Aug. 8, 2011, the entire contents of which are incorporated herein by reference.

BACKGROUND OF THE INVENTION

The present invention relates to an operation unit provided with an operation member including an outer surface having a parting line.

A typical vehicle includes electrical devices such as an air conditioner and audio equipment. An operation unit, which is arranged in the passenger compartment, is operated to control such a device. Japanese Laid-Open Patent Publication No. 2010-122992 describes an example of such an operation unit.

The operation unit of Japanese Laid-Open Patent Publication No. 2010-122992 includes a case and an operation member, which is held in a state slidable and movable relative to the case. Referring to FIG. 8, a cylindrical operation member 80 includes a slide portion 81, a step portion 82, and a knob 83. The slide portion 81 is movable relative to the case. The step portion 82 is continuous with an upper part of the slide portion 81 and has a smaller diameter than the slide portion 81. The knob 83 is continuous with an upper part of the step portion 82 and has a smaller diameter than the step portion 82. Knurls 84 are formed on the outer surface of the knob 83 to prevent slipping. Each knurl 84 is pyramidal. A lubricant such as grease is applied to the outer surface of the slide portion 81 to reduce friction between the slide portion 81 and the case. This allows for smooth rotation of the operation member 80 relative to the case.

The operation member 80 of Japanese Laid-Open Patent Publication No. 2010-122992 is injection molded. Injection molding is performed by filling a plurality of molds with thermoplastic resin. This allows for easy molding of a product having a complicated shape. However, an elevated line referred to as a parting line is formed on a molded product at where molds meet. Four parting lines PL are formed on the outer surface of the operation member 80. The four parting lines PL are formed at equal intervals in the circumferential direction. Each parting line PL extends straight from the slide portion 81 to the knob 83.

The lubricant applied to the slide portion 81 may be transferred to the knob 83 along the parting lines PL due to capillary action. When the lubricant is transferred to the knob 83, the lubricant may stick to a user's hand as the user operates the knob 83.

To solve this problem, a through hole 85 extending through the operation member 80 from its outer surface to its inner surface is arranged on each of the four parting lines PL between the knurls 84 and the slide portion 81. The through holes 85 block the capillary action of the lubricant along the parting lines PL.

Such an operation unit often includes a light source arranged in the operation member 80. This forms a path of light in the operation member 80 and illuminates a panel (not shown), which is arranged in the vicinity of the distal end of the operation member 80, from the rear. The light leaking through the panel allows the user to recognize the operation positions or the like of the operation member 80 especially in the nighttime. However, when the light source is arranged in the operation member 80, the light emitted from the light source may also leak from the through holes 85. The leaked light will illuminate the surrounding of the operation member. This is not preferable from an aesthetic viewpoint. Japanese Laid-Open Patent Publication No. 2010-122992 illustrates that the through holes 85 may be replaced by openings or recesses that do not extend through the wall of the operation member 80. However, in this case, each parting line PL remains connected and is not split apart. That is, the capillary action of the lubricant that occurs along the parting line PL is not blocked. Thus, there is a demand for development of an operation unit that suppresses the occurrence of a capillary action without the through holes 85 and prevents lubricant from leaking to the exterior.

SUMMARY OF THE INVENTION

One aspect of the present invention is an operation unit including a case and an operation member molded integrally through injection molding. The operation member includes an outer surface and a slide portion supported by the case. The slide portion is slidable and movable relative to the case. The operation member further includes a knob operated by an operator, a parting line formed continuously from the slide portion to the knob along the outer surface, and a ridge line formed on the outer surface. At least part of the parting line is formed along the ridge line.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 1 is a perspective view showing a passenger compartment including operation units;

FIG. 2A is a cross-sectional view showing an operation unit according to one embodiment of the present invention;

FIG. 2B is an enlarged cross-sectional view of FIG. 2A showing hooks;

FIG. 3B is an enlarged view of FIG. 3A showing a knob;

FIG. 3C is an enlarged view of FIG. 3A showing a region from a mounted portion to a step portion FIG. 3D is an enlarged view of FIG. 3A showing a region from the step portion to a slide portion;

DETAILED DESCRIPTION OF THE INVENTION

Figure 3A:
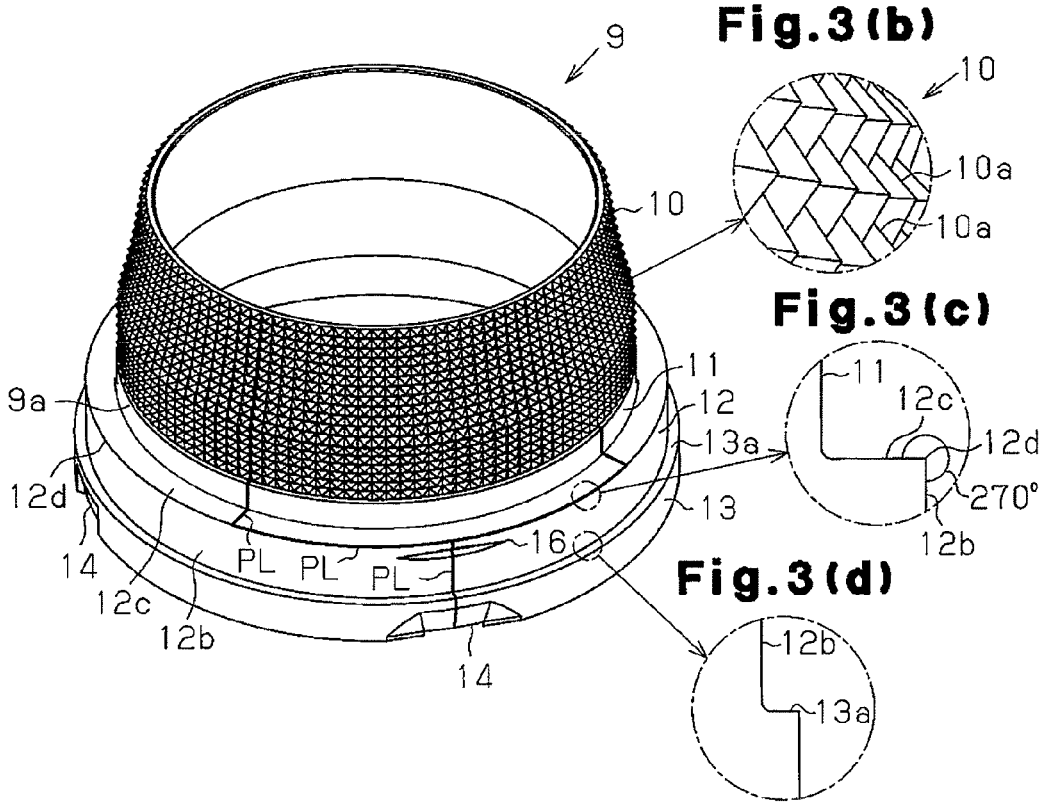
FIG. 3A is a perspective view showing an operation member of the operation unit.

An operation unit according to one embodiment of the present invention will now be described with reference to FIGS. 1 to 5. The operation unit is used to operate an air conditioner for a vehicle.

Referring to FIG. 1, an instrument panel 1 is arranged in a passenger compartment. Operation units 2 are arranged on the instrument panel 1 to adjust the temperature, change the direction of a blowing port, and adjust the airflow.

Referring to FIG. 2A, each operation unit 2 includes a case 3. The case 3 includes a main body portion 3*a*, a cylindrical mounting portion 3*b*, which extends upward from the main body portion 3*a*, and a cylindrical distal portion 3*c*, which extends upward from the mounting portion 3*b*. The main body portion 3*a* is tetragonal. The distal portion 3*c* has a smaller outer diameter than the mounting portion 3*b*. The interior of the mounting portion 3*b* is in communication with the interior of the main body portion 3*a*. The interior of the distal portion 3*c* is in communication with the mounting portion 3*b*. The case 3 includes an opening at the upper part of the distal portion 3*c* and an opening at the lower part of the main body portion 3*a*. A panel 4 closes the opening of the distal portion 3*c*. A housing 5 closes the opening of the main body portion 3*a*. The housing 5 has a U-shaped cross-section and includes an upper opening and a bottom wall. A cable hole 5*a* extends through the central part of the bottom wall in the housing 5. The case 3 is fixed to the vehicle so that the distal portion 3*c* projects into passenger compartment from the instrument panel 1.

A rotation supporting portion 3*d* is formed around the mounting portion 3*b* on an upper surface of the main body portion 3*a*. The rotation supporting portion 3*d* has a larger inner diameter than the outer diameter of the mounting portion 3*b*. Further, four hooking portions 3*e* are arranged around the rotation supporting portion 3*d* on the upper surface of the main body portion 3*a*. FIG. 2A shows only two of the hooking portions 3*e* that are located on opposite sides of the mounting portion 3*b* in the radial direction. The hooking portions 3*e* are separated from the rotation supporting portion 3*d*. Further, the hooking portions 3*e* are arranged at equal angular intervals along a circle extending around the mounting portion 3*b*. Each hooking portion 3*e* includes a distal part from which a hook 3*f* extends toward the mounting portion 3*b*. The rotation supporting portion 3*d* has a height from the upper surface of the main body portion 3*a* that is less than the distance from the upper surface of the main body portion 3*a* to the hook 3*f* of the hooking portion 3*e*.

A bearing 3*g* is formed on an inner circumferential surface of the mounting portion 3*b*. A communication hole 3*h* is formed in the lower end of the mounting portion 3*b* communicating the inner side and outer side of the case 3. The communication hole 3*h* is adjacent to the bearing 3*g*.

An insulator 6 is accommodated in the void formed by the main body portion 3*a* of the case 3 and the housing 5. The insulator 6 includes a flat fastening portion 6*a* and a cylindrical supporting portion 6*b*. The fastening portion 6*a* extends along an inner bottom surface of the main bottom surface of the main body portion 3*a* of the case 3. The supporting portion 6*b* extends downward from the lower surface of the fastening portion 6*a*. A support shaft 6*c* is formed on the outer circumferential surface of the supporting portion 6*b*. The fastening portion 6*a* includes an accommodation hole 6*d* that faces toward the support shaft 6*c* in the axial direction of the supporting portion 6*b*. The insulator 6 is fixed to the inner bottom surface of the main body portion 3*a* in the case 3 so that the support shaft 6*c* is aligned with the bearing 3*g* in the axial direction of the mounting portion 3*b* (supporting portion 6*b*).

The bearing 3*g* of the case 3 and support shaft 6*c* of the insulator 6 rotatably support a reduction gear 7. The supporting portion 6*b* of the insulator 6 rotatably supports an internal gear 8. The reduction gear 7 includes a first gear portion 7*a* and a second gear portion 7*b*. The first gear portion 7*a* includes teeth extending from its outer circumferential surface. The second gear portion 7*b* has a smaller diameter than the first gear portion 7*a*. The second gear portion 7*b* includes teeth extending from its outer circumferential surface. The first gear portion 7*a* and the second gear portion 7*b* are formed integrally on the same shaft. The teeth of the first gear portion 7*a* are arranged in correspondence with the hooks 3*f* of the case 3. The second gear portion 7*b* is engaged with the internal gear 8. The internal gear 8 is cylindrical, closed at the bottom, and open toward the insulator 6. An insertion hole 8*a* extends through the central part of the bottom wall in the internal gear 8. A cylindrical coupling portion 8*b* extends toward the insulator 6 around the insertion hole 8*a*. The coupling portion 8*b* has an inner diameter that is the same as the diameter of the insertion hole 8*a* and an outer diameter that is slightly smaller than the inner diameter of the supporting portion 6*b* of the insulator 6. An annular projection 8*c* is arranged on the bottom of the insulator 6. In a state in which the coupling portion 8*b* is arranged in the supporting portion 6*b* of the insulator 6 and the distal surface of the annular projection 8*c* is in contact with the bottom surface of the housing 5, the insulator 6 and the housing 5 rotatably support the internal gear 8. A cable (not shown) is arranged in the coupling portion 8*b*. The cable extends out of the housing through the cable hole 5*a* of the housing 5 and is connected to the air conditioner.

An operation member 9 is mounted on the mounting portion 3*b* of the case 3. Injection molding is performed to form the operation member 9. The operation member 9 is cylindrical and has two open ends. Further, the operation member 9 includes a knob 10, a mounted portion 11, a step portion 12, and a slide portion 13. The knob 10 has an inner diameter that is slightly greater than the outer diameter of the distal portion 3*c*. The mounted portion 11 has an inner diameter that is slightly greater than the outer diameter of the mounting portion 3*b*. The mounted portion 11 has an outer diameter that is greater than the outer diameter of the knob 10. The step portion 12 has an outer diameter that is greater than the outer diameter of the mounted portion 11. Further, the outer diameter of the step portion 12 is slightly less than the distance between the hooks 3*f* of two of the hooking portions 3*e* arranged on opposite sides of the mounting portion 3*b* in the radial direction. The slide portion 13 has an outer diameter that is greater than the outer diameter of the mounted portion 11. Further, the outer diameter of the slide portion 13 is greater than the distance between the hooks 3*f* of two of the hooking portions 3*e* arranged on opposite sides of the mounting portion 3*b* in the radial direction and slightly smaller than the distance between the two hooking portions 3*e*. The slide portion 13 has an inner diameter that is slightly greater than the outer diameter of the rotation supporting portion 3*d*.

The operation member 9 is mounted on the mounting portion 3*b* in a state in which the slide portion 13 is arranged at the inner side of the hooking portions 3*e* of the case 3. Referring to FIG. 2B, an upper surface 13*a* of the slide portion 13 located near the step portion 12 is engaged with the hooks 3*f* of the hooking portions 3*e*. This secures the operation member 9, in a rotatable state, to the mounting portion 3*b*. As shown in FIG. 3, the slide portion 13 includes four thin parts 14 arranged at equal angular intervals in the circumferential direction. Each thin part 14 has a thickness that gradually decreases at lower locations. Alignment of the thin parts 14 with the hooks 3*f* facilitates the engagement of the upper surface 13*a* of the slide portion 13 with the hooks 3*f*.

As shown in FIG. 2A, teeth 12*a* extend from the inner surface of the step portion 12. When the operation member 9 is mounted on the mounting portion 3*b*, the teeth 12*a* are arranged in correspondence with the hooks 3*f* of the mounting portion 3*b* and engaged with the first gear portion 7*a* of the reduction gear 7.

A resin knob top 15 is coupled to the distal part of the knob 10. The knob top 15 includes a coupling portion 15*a*, which is cylindrical and coupled to the inner surface of the knob 10, and an annular flange 15*b*, which is continuous with the upper part of the coupling portion 15*a*. The flange 15*b* has an inner diameter that is greater than the outer diameter of the panel 4. Further, the flange 15*b* has an outer diameter that is the same as the outer diameter of the distal part of the mounted portion 11. When the knob top 15 is coupled to the operation member 9, the flange 15*b* covers the distal part of the knob 10 and the peripheral part of the panel 4.

The outer diameter of the knob 10 decreases at upper locations. As shown in FIGS. 2A and 3B, pyramidal knurls 10A are formed on the entire outer circumferential surface of the knob 10 to prevent slipping.

As shown in FIG. 3A, parting lines PL are formed in the outer surface 9*a* of the operation member 9 extending over the slide portion 13, the step portion 12, the mounted portion 11, and the knob 10. Each parting line PL is an elevated line formed where molds meet when integrally molding the operation member 9 during injection molding. In the present example, two parting lines PL are formed at locations corresponding to two opposing ones of the four thin parts 14 (only one shown in the perspective view of FIG. 3A). The parting line PL extends upward and is continuous with the step portion 12.

The upper surface of the step portion 12 includes an outer circumferential surface 12*b*, which is continuous with the upper surface 13*a* of the slide portion 13, and an upper surface 12*c*, which is continuous with an upper part of the outer circumferential surface 12*b*. As shown in FIG. 3C, a ridge line 12*d* is formed as a peak extending continuously at the boundary between the outer circumferential surface 12*b* and the upper surface 12*c* throughout the entire circumference of the step portion 12. The outer circumferential surface 12*b* and the upper surface 12*c* are arranged at a major angle of 270°. A major angle is an angle between 180° and 360°. As shown in FIG. 3A, in the step portion 12, parting lines PL are formed on the outer circumferential surface 12*b*, the upper surface 12*c*, and the ridge line 12*d*. In detail, the parting lines PL formed on the outer circumferential surface 12*b* extend in the vertical direction. Each of the parting lines PL on the outer circumferential surface 12*b* have a lower part that is continuous with a parting line PL formed on the upper surface 13*a* of the slide portion 13 and an upper part that is continuous with a parting line PL formed along the ridge line 12*d*. Each parting line PL formed along the ridge line 12*d* has a length corresponding to one fourth of the entire circumference of the ridge line 12*d*. A central part in the circumferential direction of the parting line PL formed along the ridge line 12*d* is continuous with a parting line PL formed on the outer circumferential surface 12*b*. The four parting lines PL formed on the upper surface 12*c* extend in the radial direction of the operation member 9 at equal angular intervals in the circumferential direction (only two shown in the perspective view of FIG. 3A). Each parting line PL formed on the upper surface 12*c* includes a radially outer end, which is continuous with one of two circumferential ends of a parting line PL extending on the ridge line 12*d*, and a radially inner end, which is continuous with a parting line PL formed on the mounted portion 11 and the knob 10. As shown in FIG. 3D, the region where the upper surface 13*a* of the slide portion 13 is continuous with the circumferential surface 12*b* is finely curved. In the same manner, as shown in FIG. 3C, the region where the upper surface 12*c* is continuous with the outer surface of the mounted portion 11 is finely curved.

In the present example, a recess 16 is formed in the outer circumferential surface 12*b* of the step portion 12 above two of the thin parts 14. Each recess 16 has a V-shaped cross-section. Two parting lines PL are formed on the outer circumferential surface 12*b*. These two parting lines PL extend across the recesses 16.

Referring to FIG. 2A, when the knob 10 is rotated, the operation member 9 rotates as the hooks 3*f* of the hooking portions 3*e* slide on the upper surface 13*a* of the slide portion 13. A lubricant is applied between the hooking portion 3*e* and the outer surface of the slide portion 13, which slides on the hooking portions 3*e* of the case 3, to reduce friction of the slide portion 13.

The rotation of the knob 10 of the operation member 9 rotates the reduction gear 7. This rotates the internal gear 8, which is engaged with the second gear portion 7*b* of the reduction gear 7. The rotation of the internal gear 8 pulls a wire of the cable and switches the operation state of the air conditioner.

A method for manufacturing the operation member 9 will now be described.

Figure 4:
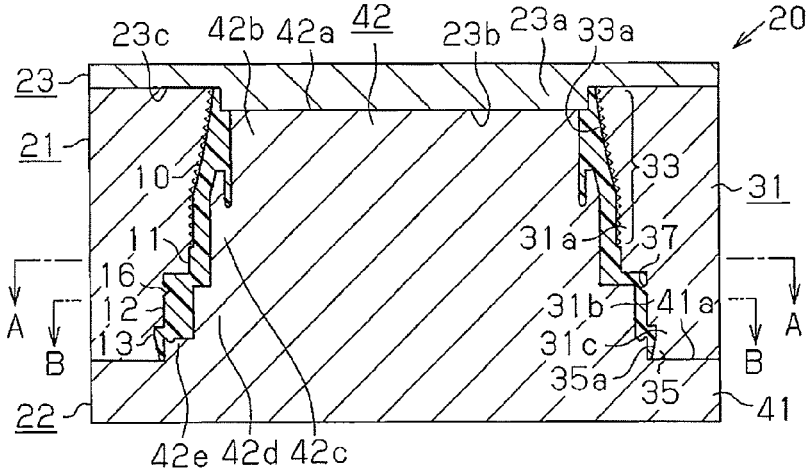
FIG. 4 is a cross-sectional view of a mold used in a process for manufacturing the operation member.

A mold 20 shown in FIG. 4 is used to integrally mold the operation member 9. The mold 20 includes an outer surface formation mold 21, an inner surface formation movable mold 22, and a fixed mold 23. The outer surface formation mold 21 is cylindrical and has two open ends. The inner surface formation movable mold 22 closes one end (lower end as viewed in FIG. 4) of the outer surface formation mold 21. The fixed mold 23 is partially fitted into the outer surface formation mold 21 and closes the outer end (upper end as viewed in FIG. 4) of the outer surface formation mold 21.

The outer surface formation mold 21 will now be described.

Figure 5A:
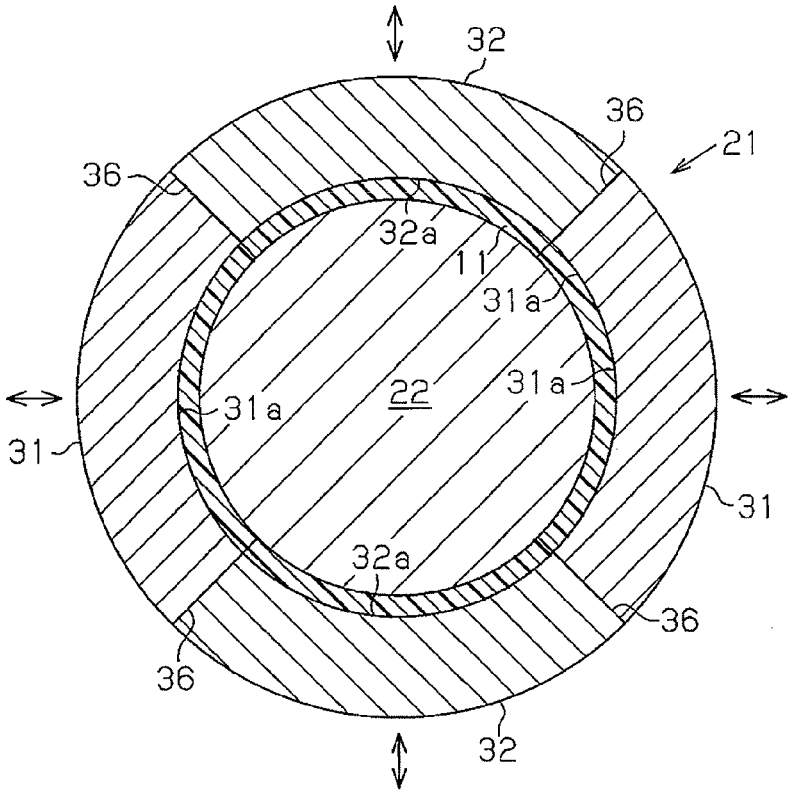
FIG. 5A is a cross-sectional view taken along line A-A in FIG. 4.
Figure 5B:
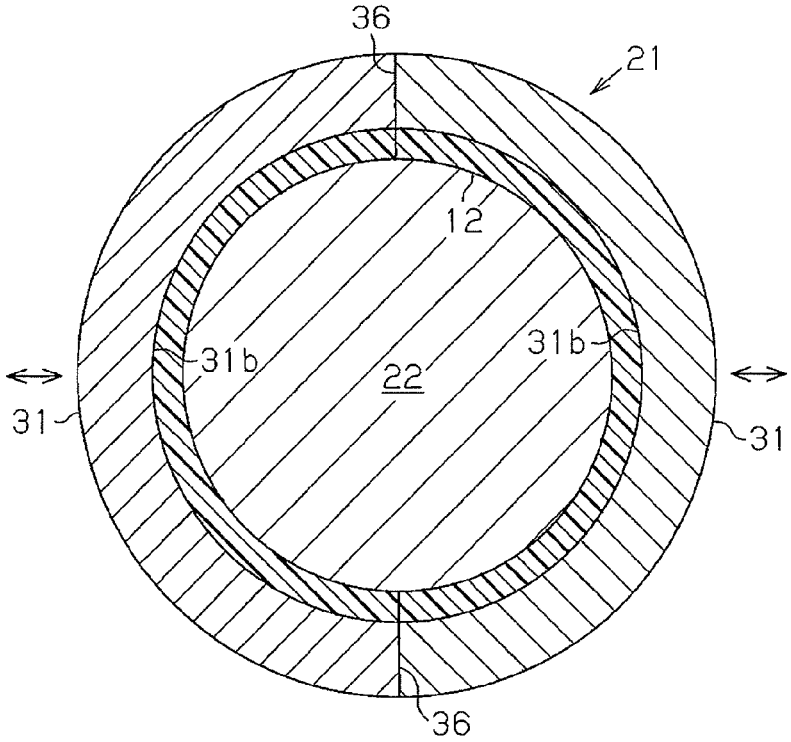
FIG. 5B is a cross-sectional view taken along line B-B in FIG. 4.

The outer surface formation mold 21 includes a total of four mold segments, namely, two first mold segments 31, which are shown in FIGS. 5A and 5B, and two second mold segments 32, which are shown in FIG. 5B. Each first mold segment 31 includes an upper molding portion 31*a*, which is shown in FIG. 5A, and a lower molding portion, which is shown in FIG. 5B. As shown in FIG. 4, the upper molding portion 31*a* includes an inner surface corresponding to the outer circumferential surfaces of the knob 10 and the mounted portion 11. The lower molding portion is formed by a step formation part 31*b*, which includes an inner surface corresponding to the outer circumferential surface of the step portion 12, and a slide portion formation part 31*c*, which includes an inner surface corresponding to the outer circumferential surface of the slide portion 13. As shown in FIG. 5A, each second mold segment 32 includes only an upper molding portion 32*a*. The upper molding portion 32*a* includes an inner surface corresponding to the outer circumferential surfaces of the knob 10 and the mounted portion 11.

Referring to FIG. 4, the upper molding portions 31*a* and 32*a* define a knob formation part 33. The second mold segments 32 and upper molding portion 32*a* are not shown in FIG. 4. The knob formation part 33 includes a plurality of pyramidal recesses 33*a*. The two first mold segments 31 include two protrusions 37, which are formed at the middle parts of the step formation parts 31*b* in the vertical direction at equal angular intervals in the circumferential direction. The protrusions 37 project in an inward direction. Further, the lower ends of the first mold segments 31 includes four partitioning projections 35 (only two shown in FIG. 4) at the lower end of the slide portion formation part 31*c* at equal angular intervals in the circumferential direction. Each partitioning projection 35 includes an inner surface 35*a* including an inclined surface gradually inclined inward toward the distal end. Although not shown in FIG. 4, each first mold segment 31 includes a projection arranged at the middle part in the circumferential direction of the lower end of the slide portion formation part 31*c*. The projection includes an inclined surface inclined gradually inward toward the distal end.

The two first mold segments 31 and the two second mold segments 32 are arranged in contact with one another in the circumferential direction to form the cylindrical outer surface formation mold 21. This forms a single projection at each location where the two first mold segments 32 meet each other. A drive mechanism (not shown) moves the two first mold segments 31 and the two mold segments 32 in the radial direction of the operation member 9 shown by solid lines in FIGS. 5A and 5B. The outward radial movement of one of the two first mold segments 31 separate a circumferential end surface 36 of the first mold segment 31 from the other first mold segment 31 and the two mold segments 32.

As shown in FIG. 4, the two upper molding portions 31*a* and the two upper molding portions 32*a* form the outer surfaces of the knob 10 and the mounted portion 11. The recesses 33*a* of the upper molding portions 31*a* and 32*a* form the knurls 10*a* of the knob 10. Further, the two step formation parts 31*b* form the outer surface of the step portion 12. The two slide portion formation parts 31*c* form the outer surface of the slide portion 13. The protrusions 37 of the step portion formation parts 31*b* form the recesses 16 of the step portion 12. The projection formed by two partitioning projections 35 adjacent to each other in the circumferential direction and formed on the two slide portion formation parts 31*c* or the projection (not shown) formed on the slide portion formation part 31*c* forms one of the thin parts 14 of the slide portion 13.

The inner surface formation movable mold 22 will now be described.

Referring to FIG. 4, the inner surface formation movable mold 22 includes a base 41, which has the form of a circular plate, and a mold projection 42, which projects vertically from the upper surface of the base 41 and is fitted to the outer surface formation mold 21.

The base 41 includes an opposing surface 41*a* opposing the outer surface formation mold 21. The opposing surface 41*a* comes into contact with the lower end surface of the outer surface formation mold 21 (i.e., the two first mold segments 31), and the base 41 closes the lower opening of the outer surface formation mold 21. The annular part of the opposing surface 41*a* of the base 41 that does not contact the lower end surface of the outer surface formation mold 21 forms the end surface of the operation member 9 at the side of the slide portion 13.

The mold projection 42 is cylindrical and has a diameter that is smaller than the inner diameter of the outer surface formation mold 21. The projection length of the mold projection 42 from the upper surface of the base 41 is set so that a distal end surface 42*a* of the mold projection 42 contacts the fixed mold 23 in a state in which the upper surface of the base 41 is in contact with the lower end surface of the outer surface formation mold 21. The inner surface formation movable mold 22 is movable in the vertical direction. A drive mechanism (not shown) moves the inner surface formation movable mold 22 in the downward direction to separate the opposing surface 41*a* of the base 41 away from the outer surface formation mold 21 and the distal end surface 42*a* of the mold projection 42 away from the fixed mold 23.

From the upper side, the mold projection 42 is formed by a first step 42*b*, which corresponds to an inner surface of the knob 10, a second step 42*c*, which corresponds to an inner surface of the mounted portion 11, a third step 42*d*, which corresponds to an inner surface of the step portion 12, and a fourth step 42*e*, which corresponds to an inner surface of the slide portion 13. In this manner, the mold projection 42 has the form of a ladder that includes four steps. The outer circumferential surface of the mold projection 42 forms the inner surface of the operation member 9. In detail, the first step 42*b* forms the inner surface of the knob 10, the second step 42*c* forms the inner surface of the mounted portion 11, the third step 42*d* forms the inner surface of the step portion 12, and the fourth step 42*e* forms the inner surface of the slide portion 13.

The fixed mold 23 will now be described.

The fixed mold 23 has the form of a circular plate and closes the upper opening of the outer surface formation mold 21. A cylindrical protrusion 23*a* protrudes from the central part of the lower surface of the fixed mold 23. The protrusion 23*a* has a larger diameter than the first step 42*b*. The movable mold contact surface 23*b* forms the inner surface of the upper part of the knob 10, that is, the part where the knob top 15 is arranged, with the outer circumferential surface of the protrusion 23*a* and an annular part excluding the part of the movable mold contact surface 23*b* contacting the distal end surface 42*a* of the mold projection 42. The fixed mold 23 includes a lower surface defining a mold segment contact surface 23*c*, which extends around the protrusion 23*a*. The mold segment contact surface 23*c* contacts the outer surface formation mold 21 (i.e., end surfaces of the first and second mold segments 31 and 32).

When manufacturing the operation member 9, first, as shown in FIG. 4, the outer surface formation mold 21 (i.e., the two first mold segments 31 and the two mold segments 32) and the fixed mold 23 are brought into contact with the inner surface formation movable mold 22. This forms a cavity having a shape corresponding to the shape of the operation member 9. The cavity includes space for forming the mounted portion 11 of the operation member 9, space for forming the step portion 12, and space for forming the slide portion 13.

Next, an injection apparatus (not shown) injects molten resin into the cavity. The molten resin is hardened. Then, the inner surface formation movable mold 22 is moved in a direction opposite to the projection direction of the mold projection 42, and the first and second mold segments 31 and 32 are moved outward in the radial direction. This allows the operation member 9 to be removed from the outer surface formation mold 21. The operation member 9 includes parting lines PL formed at locations where the upper portions of the first mold segments 31 meet the second mold segments 32 (total of four locations) and locations where the lower portions of the first mold segments 31 meet each other (total of two locations). The molten resin is not filled into parts of the cavity where the partitioning projections 35 and the projections (not shown) are arranged. These parts form the thin parts 14. In the same manner, the molten resin is not fitted into parts of the cavity where the protrusions 37 are arranged. These parts form the recesses 16. The thin parts 14 and the recesses 16 formed by the partitioning projections 35 include the partitioning lines PL. Finally, the operation member 9, which is fixed to the mold projection 42 of the inner surface formation movable mold 22, is moved in the projection direction of the mold projection 42 and removed from the mold projection 42. This forms the operation member 9.

The operation of the operation unit 2 will now be described.

As described above, a lubricant such as grease is applied to the operation member 9 between the outer surface of the slide portion 13 and the hooking portions 3*e* of the case 3 to reduce friction. The lubricant is transferred along the parting lines PL due to the usage environment, such as the temperature and the humidity.

It is know that a ridge line will hinder the transfer of a liquid such as the lubricant. The lubricant, which is applied to the slide portion 13, is transferred from the slide portion 13 to the knob 10 along the parting lines PL. The step portion 12 is located between the slide portion 13 and the knob 10. As shown in FIG. 3, the parting lines PL are formed along the ridge line 12*d* at the step portion 12. Thus, the ridge line 12*d* hinders the transfer of the lubricant. This hinders the advancement of the lubricant toward the mounted portion 11 and the knob 10.

Further, as shown in FIG. 3, the recesses 16 are formed at locations corresponding to the parting lines PL in the outer circumferential surface 12*b* of the step portion 12. The recesses 16 collect the lubricant transferred from the slide portion 13 along the parting lines PL. In other words, the transfer of the lubricant from the slide portion 13 to the knob 10 along the parting lines PL is suppressed.

The present embodiment has the advantages described below.

(1) The parting lines PL of the slide portion 13 (step portion) are shifted from the parting lines PL of the mounted portion 11 (knob 10) in the circumferential direction at the ridge line 12*d*. It is well known that a ridge line hinders the transfer of liquid. Thus, the ridge line 12*d* hinders the flow of the lubricant along the parting lines PL. Further, the transfer of the lubricant from the slide portion 13 to the knob 10 along the parting lines PL is suppressed.

(2) The parting lines PL of the slide portion 13 are shifted from the parting lines formed on the mounted portion 11. The ends of each parting line PL formed on the ridge line 12*d* connects one end of a parting line PL formed on the slide portion 13 to one end of a parting line PL formed on the mounted portion 11. Thus, the two ends of each parting line PL formed on the ridge line 12*d* form peaks at where the continuous parting line PL is bent. The peaks hinder the flow of the lubricant along the parting lines PL. Thus, the transfer of the lubricant from the slide portion 13 to the knob 10 along the parting lines PL is suppressed.

(3) Each parting line PL extending upward from the slide portion 13 is branched into two directions at the ridge line 12*d*. Thus, more parting lines PL are formed at the step portion 12 than the slide portion 13. This increases the paths along which the lubricant is transferred upward in the operation member 9 and increases the amount of lubricant required to be transferred upward. Thus, less lubricant leaks from the paths as compared to when the same amount of lubricant is applied to a slide portion 13 having less paths. Further, the parting lines PL include fine steps. This increases slide resistance when the number of the parting lines PL increases at the slide portion 13. In this respect, the slide portion 13 includes a small number of the parting lines PL. This suppresses the slide resistance at the slide portion 13. Accordingly, the operation unit is easy to operate and lubricant does not leak out of the operation unit.

(4) The corner formed between the upper surface 13*a* and the outer circumferential surface 12*b* and the corner formed between the upper surface 12*c* and the outer circumferential surface of the mounted portion 11 includes curved portions that are finely curved. The curved portions suppress the occurrence of a capillary action. In other words, the curved portions suppress the dispersion of the lubricant.

It should be apparent to those skilled in the art that the present invention may be embodied in many other specific forms without departing from the spirit or scope of the invention. Particularly, it should be understood that the present invention may be embodied in the following forms.

Figure 6:
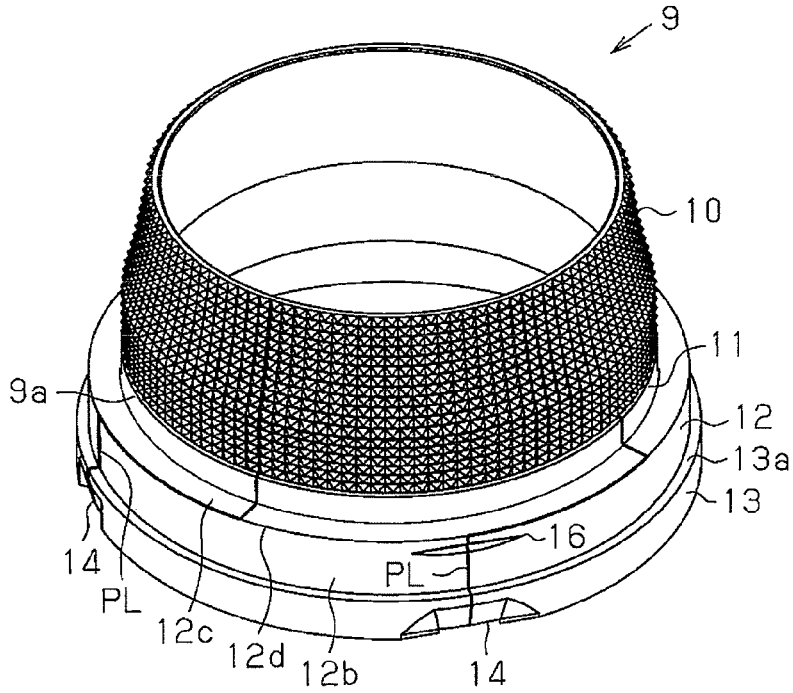
FIG. 6 is a perspective view showing a modification of the operation member.
Figure 7:
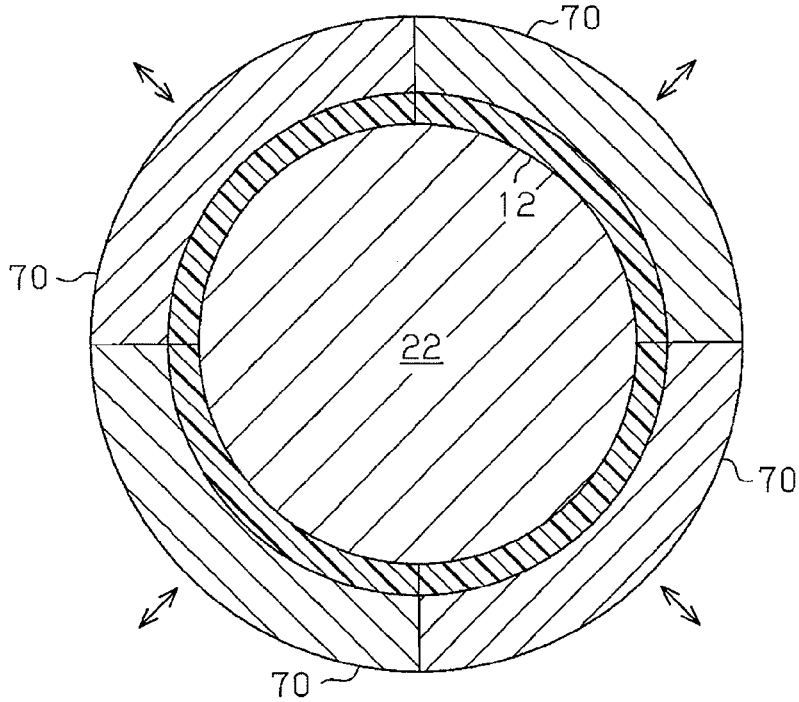
FIG. 7 is a cross-sectional view showing a process for manufacturing the operation member of FIG. 6 taken along a plane corresponding to line B-B in FIG. 4.
Figure 8:
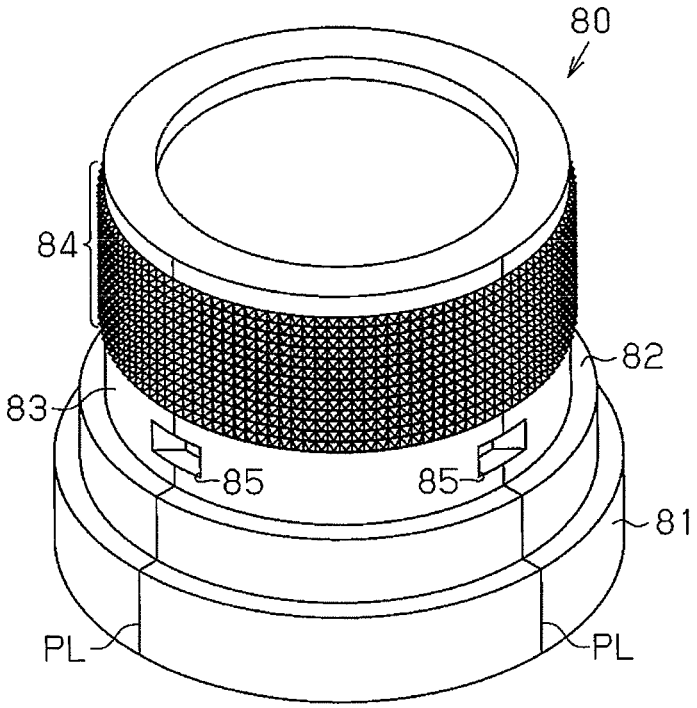
Fig.8(Prior Art)
FIG. 8 is a perspective view showing an operation member of the prior art.

In the above embodiment, the outer surface formation mold 21 includes the first mold segments 31 and the second mold segments 32 that have different shapes. Each parting line PL formed on the outer surface of the operation member 9 is branched into two directions at the ridge line 12*d*. However, such branching is not necessarily required. For example, as shown in FIG. 6, four parting lines PL may extend from the slide portion 13 to the knob 10 at equal angular intervals in the circumferential direction. The four parting lines PL are shifted by 90° from one another at the ridge line 12*d*. In this case, as shown in FIG. 7, the outer surface formation mold 21 includes four identical mold segments 70. In comparison with the upper embodiment, this structure decreases the distance in which a drive mechanism (not shown) moves the mold segments 70 when forming the operation member 9. This allows for reduction in size of a machine tool that forms the operation member 9.

In the above embodiment, the parting lines PL are arranged in the ridge lines 12*d* of the step portion 12 but may be arranged at other locations. For example, a parting line PL may be arranged in the ridge line of the slide portion 13 or the knob 10 of the mounted portion 11. Further, a plurality of parting lines PL may be arranged at these locations. Such a structure would have the same advantages as the above embodiment.

In the above embodiment, the ridge line 12*d* is formed by a portion at which a peak of 270° continues. However, the peak is not limited to 270° as long as the peak has a major angle of 180° to 360°.

In the above embodiment, the corner between the upper surface 13*a* and the outer circumferential surface 12*b* and the corner between the upper surface 12*c* and the outer circumferential surface of the mounted portion 11 are finely curved but do not have to be curved. Such a structure would still obtain advantages (1) to (3) of the above embodiment.

In the above embodiment, the outer surface of the operation member 9 excluding the slide portion 13, namely, the outer surfaces of the knob 10, the mounted portion 11, and the step portion 12 do not have to be cylindrical. These outer surfaces may be polygonal and include ridge lines. For example, the outer surfaces may be hexagonal or octagonal. In this case, the formation of the parting lines PL on the ridge lines of the polygon will suppress the leakage of lubricant at the knob 10.

In the above embodiment, the thin parts 14 and the recesses 16 are formed during injection molding. However, the thin parts 14 and the recesses 16 may be formed after injection molding the operation member 9 through, for example, machining, grinding, laser processing, thermal processing, or ultrasonic processing. Further, after injection molding the operation member 9, part of the outer surface 9*a* of the operation member 9 may be eliminated or melted to divide apart the parting line PL.

The above embodiment is applied to an operation unit that rotates the operation member, that is, a rotary switch. However, the present invention may also be applied to an operation unit that pushes an operation member, that is, a push switch, as long as the outer surface of the operation member includes a slide portion and a parting line.

In the above embodiment, the operation unit 2 is used with the air conditioner but may be used for an in-vehicle device such as audio equipment to adjust the volume. The operation unit 2 may also be used as a switch unit for a device other than an in-vehicle device.

The present examples and embodiments are to be considered as illustrative and not restrictive, and the invention is not to be limited to the details given herein, but may be modified within the scope and equivalence of the appended claims.

The invention claimed is:

1. An operation unit comprising:

a case;

a slide portion supported by the case, wherein the slide portion is slidable and movable relative to the case;

a knob configured to be operated by an operator, the slide portion and the knob being integrally formed;

an outer surface provided by the slide portion and the knob;

a parting line extending continuously from the slide portion to the knob along the outer surface, the parting line including at least two circumferentially offset portions;

wherein a ridge line is provided on the outer surface, and wherein at least part of the parting line extends along the ridge line.

2. The operation unit according to claim 1, wherein the outer surface includes a first outer surface, which is defined on the slide portion, and a second outer surface, which is defined on the knob; and the parting line includes a first portion, which is provided on the first outer surface of the slide portion, a second portion, which is provided on the second outer surface of the knob, and a third portion, which is provided along a first portion of the ridge line located between the first portion and the second portion.

3. The operation unit according to claim 2, wherein the parting line includes a fourth portion, which is provided at a location different from the second portion provided on the second outer surface of the knob, and a fifth portion, which is provided along a second portion of the ridge line located between the first portion and the fourth portion.

4. The operation unit according to claim 2, wherein the first portion of the parting line is shifted in a circumferential direction of the outer surface from the second portion of the parting line.

5. The operation unit according to claim 1, wherein the outer surface includes a step located between the slide portion and the knob, and the step comprises the ridge line.

6. The operation unit according to claim 5, the step being configured by a junction of transversely extending surfaces of the outer surface.

7. The operation unit according to claim 1, wherein the outer surface has a recess, and at least part of the parting line extends across the recess.

8. The operation unit according to claim 7, wherein the recess has a generally V-shaped cross-section.

9. The operation unit according to claim 1, wherein at least a part of the parting line, that does not extend along the ridge line, extends traverse to the ridge line.

10. The operation unit according to claim 1, at least a part of the parting line extending within a plane that intersects a rotational axis of the knob.

11. The operation unit according to claim 1, the slide portion including a plurality of thin parts positioned at equal angular intervals in a circumferential direction, each thin part having a thickness that gradually decreases, the thin parts being configured for engagement with a hook portion of the case.

12. The operation unit according to claim 11, the parting line extending through at least one of the thin parts.

13. The operation unit according to claim 1, wherein the ridge line is configured to hinder movement of lubricant from the slide portion to the knob.

14. The operation unit according to claim 1, the parting line being provided where molds, forming the integral slide part and the knob, meet.

15. An operation unit comprising:

a case;

a slide portion supported by the case, wherein the slide portion is slidable and movable relative to the case;

a knob configured to be operated by an operator, the slide portion and the knob being integrally formed;

an outer surface provided by the slide portion and the knob, the outer surface including a recess;

a parting line extending continuously from the slide portion to the knob along the outer surface;

wherein a ridge line is provided on the outer surface, and wherein at least part of the parting line extends circumferentially along the ridge line, and at least part of the parting line extends across the recess.

16. The operation unit according to claim 15, wherein the recess has a generally V-shaped cross-section.

* * * * *